US007836797B2

(12) United States Patent
Hecht et al.

(10) Patent No.: US 7,836,797 B2
(45) Date of Patent: Nov. 23, 2010

(54) TOOL RATCHET

(75) Inventors: Joachim Hecht, Magstadt (DE); Martin Kraus, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 18 days.

(21) Appl. No.: 11/924,331

(22) Filed: Oct. 25, 2007

(65) Prior Publication Data

US 2008/0115632 A1 May 22, 2008

(30) Foreign Application Priority Data

Nov. 16, 2006 (DE) ..... 10 2006 054 190

(51) Int. Cl.
*B25B 21/00* (2006.01)

(52) U.S. Cl. ..... 81/57.3; 81/57.14; 81/62

(58) Field of Classification Search ..... 81/57.3, 81/57.11–57.14, 52, 54, 62, 473–476
See application file for complete search history.

(56) References Cited

U.S. PATENT DOCUMENTS

| | | | | |
|---|---|---|---|---|
| 3,939,924 A | | 2/1976 | Grabovac | |
| 4,448,098 A | * | 5/1984 | Totsu | 81/467 |
| 4,919,022 A | | 4/1990 | Ono et al. | |
| 4,974,475 A | * | 12/1990 | Lord et al. | 81/57.13 |
| 5,251,706 A | | 10/1993 | Evans | |
| 5,562,015 A | | 10/1996 | Zinck | |
| 5,924,340 A | | 7/1999 | Junkers | |
| 6,568,298 B1 | | 5/2003 | Zinck | |
| 7,069,816 B1 | | 7/2006 | Saathoff et al. | |

FOREIGN PATENT DOCUMENTS

| | | |
|---|---|---|
| EP | 0 026 738 | 4/1981 |
| GB | 1 263 348 | 2/1972 |
| GB | 1 300 713 | 12/1972 |
| GB | 2 354 193 | 3/2001 |
| JP | 7-124871 | 5/1995 |

* cited by examiner

*Primary Examiner*—D. S Meislin
(74) *Attorney, Agent, or Firm*—Michael J. Striker

(57) ABSTRACT

A tool ratchet for tightening and loosening screws and/or nuts and the like, has a handle and a receiving piece operatively connected with handle via a ratchet mechanism, and with an electric motor, with which torque is transferable to the receiving piece via a non-positive connection, and a coupling for disconnecting the non-positive connection.

10 Claims, 3 Drawing Sheets

TOOL RATCHET

CROSS-REFERENCE TO A RELATED APPLICATION

The invention described and claimed hereinbelow is also described in German Patent Application DE 102006054190.1 filed on Nov. 16, 2006. This German Patent Application, whose subject matter is incorporated here by reference, provides the basis for a claim of priority of invention under 35 U.S.C. 119(a)-(d).

BACKGROUND OF THE INVENTION

The present invention relates to a tool ratchet (ratchet) for tightening and loosening screws and/or nuts and the like.

Tool ratchets are commonly known tools, for manually tightening and loosening screws or nuts in particular. A receiving piece is provided for receiving screws, nuts, or adapters (e.g., socket), which is adapted to the contour of the nut, screw, or the adapter, thereby enabling torque to be transferred. The receiving piece is connected with the handle via a ratchet mechanism—also referred to as a freewheel or locking pawl mechanism—such that, in one direction of rotation, torque may be transferred to the screw or nut, while, in the opposite direction, the handle is free to rotate relative to the receiving piece. Tool ratchets typically include a switchover mechanism, with which the direction of torque transfer and the freewheeling direction may be switched.

In addition to the generally known, manually operated tool ratchets, tool ratchets with an integrated electric motor are also known. A tool ratchet of this type is described, e.g., in U.S. Pat. No. 5,562,015. The disadvantage of the known ratchet is that it must be operated with an electric motor. If the handle were rotated in the freewheeling direction with the motor turned off, a nut to be tightened would be loosened, since a load moment would always be present at the receiving piece, due to the permanent mechanical connection with the electric motor.

Publication GB 2354193 A makes known a ratchet-like tool with an electric motor, which does not include a ratchet mechanism, however, and must therefore also be operated with an electric motor.

Publication U.S. Pat. No. 5,924,340 A describes a ratchet tool with a permanently coupled hydraulic linear drive.

SUMMARY OF THE INVENTION

The object of the present invention is to provide a tool ratchet that is drivable with an electric motor, and that may also be used manually.

In keeping with these objects and with others which will become apparent hereinafter, one feature of the present invention resides, briefly stated, in a tool ratchet for tightening and loosening screws and/or nuts and the like, comprising a handle; a receiving piece which is operatively connected with said handle; a ratchet mechanism which operatively connects said receiving piece with said handle; an electric motor with which torque is transferred to said receiving piece via a non-positive connection; and a coupling provided for disconnecting said non-positive connection.

The present invention is based on the idea of providing a coupling in the force transmission chain between the electric motor and the receiving piece, with which the non-positive connection between the electric motor and the receiving piece may be disconnected, so that, when the handle is rotated in the freewheeling direction, a load moment of the switched-off electric motor is not present at the receiving piece, thereby preventing screws or nuts from being accidentally loosened or tightened.

The electric motor of the inventive tool ratchet serves primarily to overcome the first rotational path of a nut—when tightening—or the last, easily moving rotational path of a nut—when loosening—as quickly as possible without the need to rotate the handle in the freewheeling direction, since, with the known ratchets, the receiving piece typically must be braked manually in order to prevent the nut from being carried along in the freewheeling direction (i.e., against the desired direction of rotation of the screw or nut).

It is therefore possible to use electric motors with relatively low output, since the electric motor is not used to perform the final tightening of the screw or nut, or to loosen it from its tightened position. Since low-output motors may be used, the overall size of the inventive ratchet is nearly the same as or identical to that of known series-production ratchets without electric motors, thereby allowing the inventive ratchet to be used anywhere that ratchets are currently used. Nuts or screws may be tightened or loosened much faster using the inventive tool ratchet. Basically, the present invention may be combined with any known ratchet mechanism.

In a refinement of the present invention, a switch for actuating the coupling is advantageously provided, on the handle in particular. Advantageously, the mechanical switching force is applied directly via the switch, to separate two—in particular—coupling components, and/or to connect them in a non-positive (form-fit and/or friction-based) manner.

It is particularly advantageous when the switch for actuating the coupling serves simultaneously to switch the electric motor on and off. A separate switch therefore need not be provided.

It is also possible to provide a switch with which the direction of torque transfer may be switched, the electric motor may be switched on and off, and the coupling may be opened or separated.

Preferably, the switching mechanism that is actuatable via the single switch is designed such that the electric motor is not turned on until the coupling is engaged, i.e., after the non-positive connection has been established, thereby minimizing wear of coupling components caused by components that are already being driven. The switching mechanism is preferably simultaneously designed such that the electric motor is switched off before the coupling components are separated from each other and, therefore, the non-positive connection between the electric motor and the receiving piece is disconnected.

To protect the transmission and the electric motor from overload, it is provided in a refinement of the present invention that the coupling is designed as an overload coupling, which automatically disengages when a maximum load torque of, e.g., 0.5 Nm, is exceeded, thereby preventing damage to components.

It is advantageous to design the preferably single switch as a sliding switch, which interacts with a spring, preferably a leaf spring. The sliding switch glides along the spring, which is preferably provided with at least one slanted surface, by way of which the spring exerts a force on a first coupling component, which causes it to move in the direction of a second coupling component, thereby ultimately establishing a non-positive connection. During disengagement, the switch is slid in the opposite direction, which causes the spring load of the first coupling component to at least decrease, thereby moving the first coupling component away from the second coupling component—preferably by one of the springs which acts against the spring mentioned—and disconnecting the non-positive connection.

It is advantageous that the two coupling components are designed as gearwheels, so that the coupling also serves a transmission function when in the engaged state. One possibility for realizing a non-positive connection between the two gearwheels is to provide an end-face bolt on at least one of the two gearwheels, which may be accommodated in a corresponding recess located on the end face of the other gearwheel, by way of which a force may be transferred in the circumferential direction.

An overload coupling may be realized in a simple manner by positioning the bolt at a slant or by providing the bolt with an oblique angle, since, due to the slanted direction, a force component is provided in the direction away from the opposite gearwheel, i.e., in the disengagement direction.

According to an advantageous embodiment of the present invention, it is provided that the tool ratchet is provided with a direction switch, so that the direction of torque transfer and the freewheeling direction may be switched, thereby making it possible for the tool ratchet to be used to tighten and loosen screws or nuts. It is particularly advantageous when the direction of rotation of the electric motor may be switched simultaneously using the direction switch, in particular by using a polarity divider.

According to an embodiment of the present invention with an advantageous design, it is provided that the ratchet mechanism includes a gear that is non-rotatably connected with the receiving piece, which interacts with at least one resilient or resiliently supported locking pawl. Ratchet mechanisms with other designs are also feasible, of course.

The novel features of which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
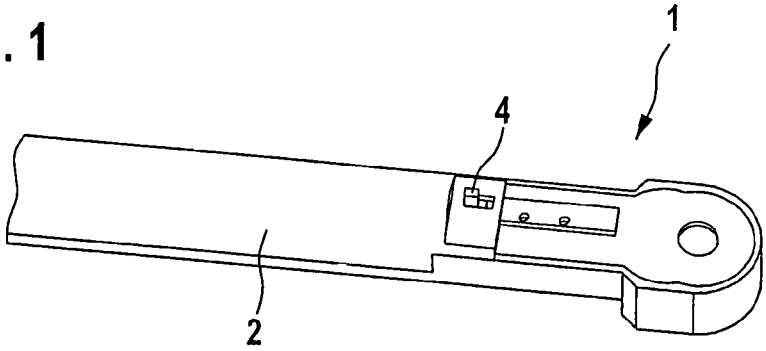
FIG. 1 shows a perspective view of an inventive tool ratchet, viewed at a slant from above.

A tool ratchet 1 is shown in FIG. 1, in a perspective view from above. Tool ratchet 1 includes a longitudinal handle 2, with which torque may be applied in the circumferential direction to receiving piece 3 shown in FIG. 2. A switch 4 designed as a sliding switch is also shown, with which an electric motor—to be explained below—located inside handle 2 may be switched on and off, and with which a coupling—which will also be explained below—may be engaged and disengaged.

Figure 2:
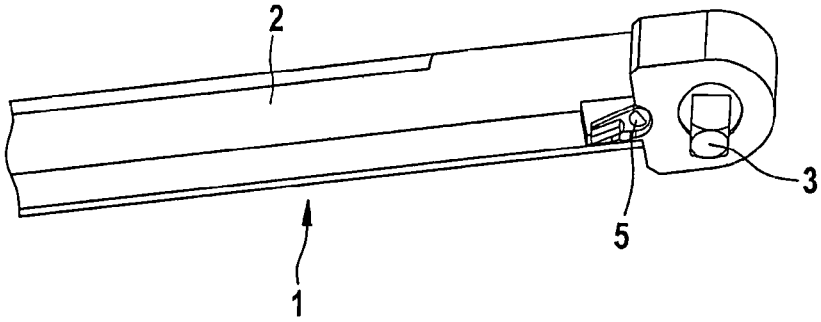
FIG. 2 shows a rotated perspective view of the tool ratchet in FIG. 2, viewed at a slant from below.

Tool ratchet 1 is shown in FIG. 2 in a view diagonally from below. A direction switch 5 is located on the underside, with which the direction of torque transfer may be switched. Receiving piece 3 has a square cross section for receiving a socket. Receiving piece 3 may have any type of contour, however, so that it may rotatably actuate pieces that have matching designs.

Figure 3:
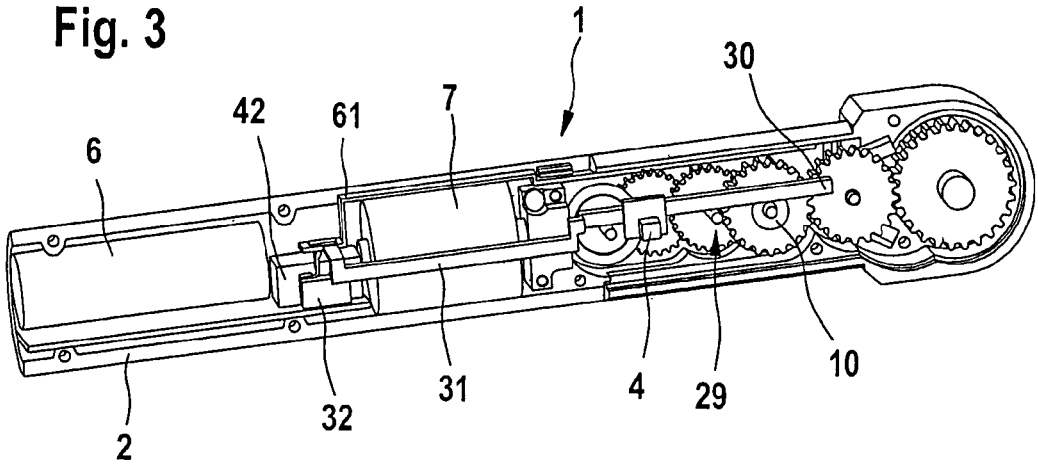
FIG. 3 shows a perspective illustration of the internal design of a tool ratchet with electric motor, transmission, coupling, coupling switching mechanism, and ratchet mechanism.
Figure 4:
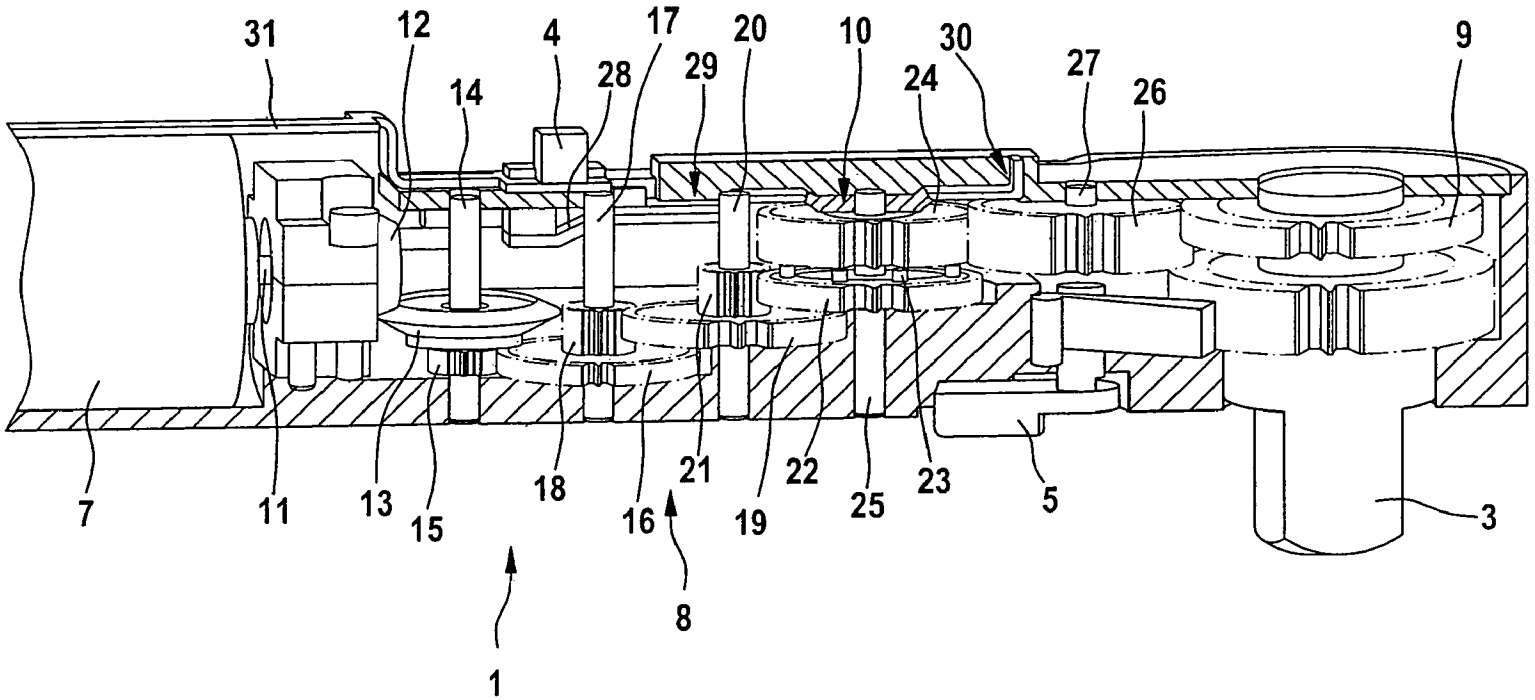
FIG. 4 shows a further perspective view of the components of the tool ratchet in accordance with the present invention.

The inner mechanisms of tool ratchet 1 are shown in detail in a perspective view in FIGS. 3 and 4. A battery or a rechargeable battery 6 is located in the region of the free end of handle 2, which supplies a direct-current electric motor 7—which is separated axially therefrom—with power. When electric motor 7 is turned on using switch 4, it transfers torque via a multistaged transmission 8 to a spur gear 9, which is non-rotatably connected with receiving piece 3. Electric motor 7 is a motor with low power consumption and a rotational speed of approximately 5000 to 7000 revolutions per minute. Using transmission 8, the rotational speed is reduced to approximately one revolution per second on spur gear 9 and, therefore, receiving piece 3.

A coupling 10 is integrated in transmission 8. When the coupling is engaged and electric motor 7 is switched on, the latter transfers torque to receiving piece 3. Via a bevel gear 12 mounted non-rotatably on motor shaft 11, torque is transferred to a bevel gear 13 located at a right angle to bevel gear 12. Bevel gear 13 is located non-rotatably on a shaft 14 supported inside handle 2. A spur gear 15 is also mounted non-rotatably on shaft 14, the diameter of which is smaller than the diameter of bevel gear 13. Spur gear 15 meshes with a spur gear 16 located on a shaft 17 that is parallel to shaft 14. The diameter of spur gear 16 is larger than that of spur gear 15. Adjacent to spur gear 16, a spur gear 18 is also mounted non-rotatably on shaft 17, and it has a smaller diameter than that of spur gear 16. Spur gear 18 meshes with a spur gear 19, which has a larger diameter than that of spur gear 18. In addition to spur gear 19, a spur gear 21 with a smaller diameter than the diameter of spur gear 19 is also located on shaft 20, which extends parallel to shafts 14 and 17.

Spur gear 21 engages with a second coupling component 22, which is designed as a spur gear. Second coupling component 22 is capable of being engaged via several axial, beveled bolts 23 separated from each other in the circumferential direction with a first coupling component 24, which is also designed as a spur gear. Recesses for bolts 23 are provided in the end face of first coupling component 24 for this purpose. Bolts 23 are not shown in the figures. First coupling component 24 is located on the same shaft 25 as second coupling component 22, but second coupling component 22 is non-rotatably connected with shaft 25. First coupling component 24 is displaceable in the axial direction on shaft 25.

A not-shown spring is located between the two coupling components 22, 24. The not-shown spring tries to separate the two coupling components 22, 24, i.e., to disengage them. In the engaged state, torque is transferred by first coupling component 24 to a spur gear 26 located on a shaft 27. From there, torque is transferred further to spur gear 9 and, therefore, to receiving piece 3. It is also feasible to eliminate spur gear 26, for example, and to provide a belt drive between first coupling component 24 and receiving piece 3. It is possible to use a planetary gear set instead of spur gear transmission 8 shown.

To engage coupling 10, switch 4 is displaced in the direction of receiving piece 3. Due to bevel 28, this action causes a spring 29—which is designed as a leaf spring and is fixed in position at end 30 facing away from switch 4—to move in the direction of first coupling component 24, which, in turn, is displaced axially on shaft 25 in the direction of second coupling component 22, which causes bolts 23 to slide into the corresponding recesses. As a result, a non-positive connection between electric motor 7 and receiving piece 3 is established. At the same time, the displacement of switch 4 described above actuates a sliding element 31 fixedly connected with switch 4, via which an electrical contact 32 is closed and electric motor 7 is therefore turned on. When switch 4 is moved back, electrical contact 32 is initially opened, which causes spring 29 to be moved away from first coupling component 24. Due to the not-shown spring located between two coupling components 22, 24, first coupling component 24 is lifted off of second coupling component 22, which causes bolts 23 to disengage from the recesses in first coupling component 24. The non-positive connection between electric motor 7 and the receiving piece is therefore disconnected.

When a mechanical overload occurs, the bevel of bolt 23 causes first coupling component 24 to move in the axial direction out of the engaged position against the spring force of spring 29, by way of which an overload coupling is realized. Bevel of bolts 23 also makes it easier to locate the corresponding recesses.

Instead of rotatably supported shafts 14, 17, 20 and 27, fixed axles may also be provided, on which double gearwheels are rotatably mounted. If shaft 25 (shaft of coupling 10) is designed as a fixed axle, gears 22 and 24 are not designed as double gearwheels. Instead, they are independent components that may be displaced axially relative to each other.

Figure 5:
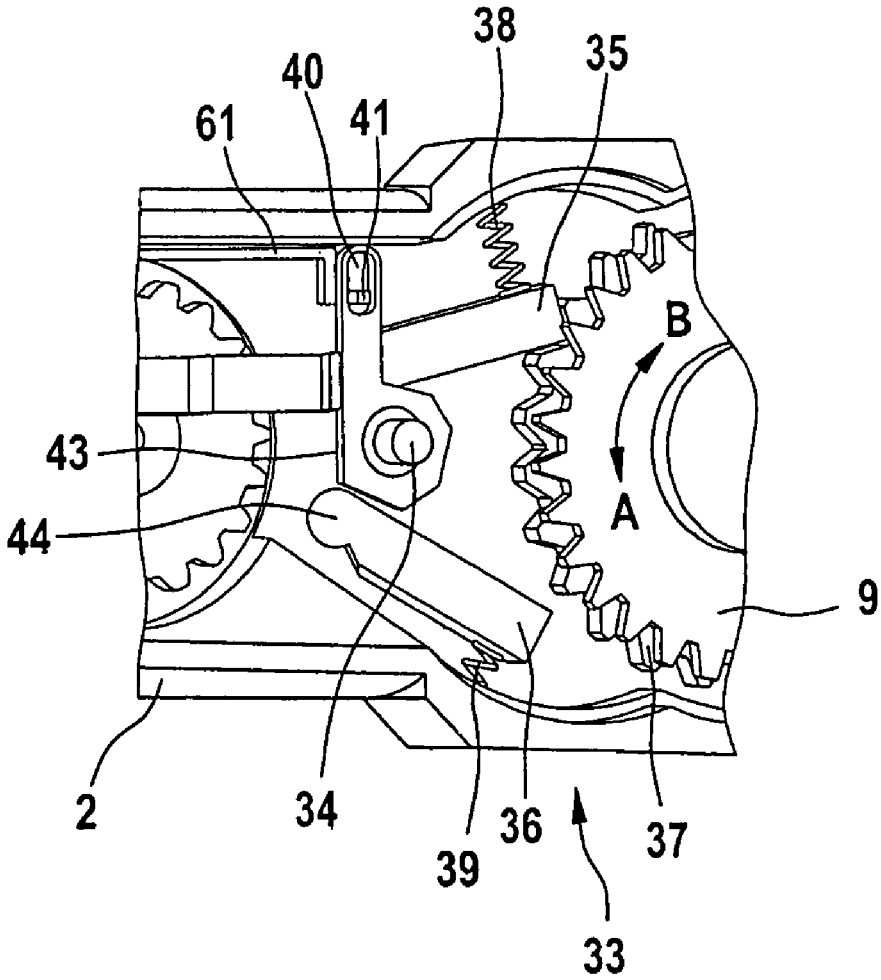
FIG. 5 shows a ratchet mechanism in accordance with the present invention.

Ratchet mechanism 33 of tool ratchet 1 is shown in detail in FIG. 5. Ratchet mechanism 33 is equipped with a switchover device for selecting a direction of torque transmission. Direction switch 5 is provided to actuate it. Direction switch 5 is non-rotatably connected with a shaft 34, which, in turn, is non-rotatably connected with an eccentric, which is hidden in FIG. 5 behind a component 43 that has been pressed onto shaft 34. The eccentric, which may be designed as a single piece with shaft 34, interacts with two locking pawls 35, 36, which are interconnected at an angle and which are both located such that they may swivel around rotation point 44, via which—due to the rotation of direction switch 5—one or the other locking pawl 35, 36 is capable of being brought into operative contact via the eccentric with a spur gear 37 that is non-rotatably connected with receiving piece 3. Locking pawls 35, 36 are acted on with spring force in the direction of spur gear 37 by springs 38, 39. When handle 2 is moved in arrow direction A, with locking pawls 35, 36 in the position shown, locking pawl 35 glides along spur gear 37 (freewheeling). If, however, handle 2 is moved in arrow direction B, torque is transferred via locking pawl 35 to spur gear 37 and, therefore, to receiving piece 3.

Component 43, which is non-rotatably connected with a shaft 34, is connected as a single piece with a slotted guide 40, which is displaceably guided on a fixed bolt 41. A sliding element 61 is connected with slotted guide 40, which is connected with a bar 42 for controlling electric motor 7. Sliding element 42 is used to select the direction of rotation of electric motor 7.

Electric motor 2 is preferably switched such that it may only rotate receiving piece 3 in the direction of torque transmission that was selected (i.e, direction B in the present exemplary embodiment).

It will be understood that each of the elements described above, or two or more together, may also find a useful application in other types of constructions differing from the type described above.

While the invention has been illustrated and described as embodied in a tool ratchet, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A ratchet tool for tightening and loosening objects including screws and/or nuts and the like, comprising:

a handle;

a receiving piece;

a ratchet mechanism which operatively connects said receiving piece with said handle;

an electric motor with which torque is transferred to said receiving piece by a transmission via a connection between said electric motor and said receiving piece;

a coupling provided for disconnecting said connection, said coupling being arranged in said transmission and having a first coupling component and a second coupling component; and a switch electrically and mechanically configured to separate and to connect said two coupling components so that said coupling is disengaged and engaged, respectively, wherein said switch is a single switch configured for turning said electric motor on and off and for actuating said coupling, wherein said switch is configured as a sliding switch that interacts with a spring which, when said switch is displaced, connects said first coupling component with said second coupling component in the connection via a spring applying a spring force to said first coupling component in a direction of said second coupling component.

2. A ratchet tool as defined in claim 1, wherein said switch is for actuating said coupling and is provided on said handle.

3. A ratchet tool as defined in claim 1; and further comprising a switching mechanism which is actuatable using said single switch.

4. A ratchet tool as defined in claim 1, wherein said coupling is configured as an overload coupling that disengages automatically when a maximum load torque is exceeded.

5. A ratchet tool as defined in claim 1, wherein said spring is configured as a leaf spring.

6. A ratchet tool as defined in claim 1; and further comprising a direction switch, with which a direction of torque transmission via said ratchet mechanism and a direction of rotation of said electric motor are selectable simultaneously.

7. A ratchet tool as defined in claim 1, wherein said ratchet mechanism includes a gear that is non-rotatably connected with said receiving piece and interacts with at least one locking pawl located on a handle side.

8. A ratchet tool as defined in claim 7, wherein said locking pawl is resiliently supported.

9. A ratchet tool for tightening and loosening objects including screws and/or nuts and the like, comprising:

a handle;

a receiving piece;

a ratchet mechanism which operatively connects said receiving piece with said handle;

an electric motor with which torque is transferred to said receiving piece by a transmission via a connection between said electric motor and said receiving piece;

a coupling provided for disconnecting said connection, said coupling being arranged in said transmission and having a first coupling component and a second coupling component; and a switch electrically and mechanically configured to separate and to connect said two coupling components so that said coupling is disengaged and engaged, respectively, wherein said switch is a single switch configured for turning said electric motor on and off and for actuating said coupling, wherein said two coupling components are gear wheels that are connectable with each other in the non positive connection in that at least one bolt located on an end face of one of said gear wheels is accommodated in a corresponding end-face receptacle in the other of said gear wheels.

10. A ratchet tool as defined in claim 9, wherein said bolt is provided with a slanted surface.

* * * * *